United States Patent [19]

Fowler, Jr.

[11] Patent Number: 4,542,928

[45] Date of Patent: Sep. 24, 1985

[54] CRANE/HOIST FORKLIFT-TYPE LIFTING APPARATUS

[76] Inventor: Aubrey A. Fowler, Jr., P.O. Box 416, Fairmont, N.C. 28340

[21] Appl. No.: 640,518

[22] Filed: Aug. 14, 1984

Related U.S. Application Data

[63] Continuation-in-part of Ser. No. 487,319, Apr. 21, 1983.

[51] Int. Cl.[4] ..... B66C 1/00

[52] U.S. Cl. ..... 294/81.1; 294/67.2

[58] Field of Search ..... 294/81 R, 67 A, 67 AA, 294/67 AB, 63 R, 82 R, 103 R, 88, 81 SF; 414/715, 719, 722, 723, 785, 608, 640, 641, 642, 673

[56] References Cited

U.S. PATENT DOCUMENTS 3,173,556 3/1965 Gaudriot et al. ..... 294/81 SF
3,661,415 5/1972 Piasecki ..... 294/81 R
3,897,097 7/1975 Davis, Jr. ..... 294/67 A

FOREIGN PATENT DOCUMENTS 1462379 11/1966 France ..... 294/67 A
791430 3/1958 United Kingdom ..... 294/67 A

*Primary Examiner*—James B. Marbert
*Attorney, Agent, or Firm*—B. B. Olive

[57] ABSTRACT

A crane forklift-type lifting apparatus comprises a pair of C-shaped claws or forks and integral frame structure and is adapted to be initially supported from an over-center spring-loaded device for improved accommodation to varying non-level or off-balanced loading conditions. The center or point of balance cable assumes a taut position as a load is lifted and the four outer corner cables then take up the load. Means is also provided for enclosing the C-forks once a load has been positioned on the C-forks.

3 Claims, 12 Drawing Figures

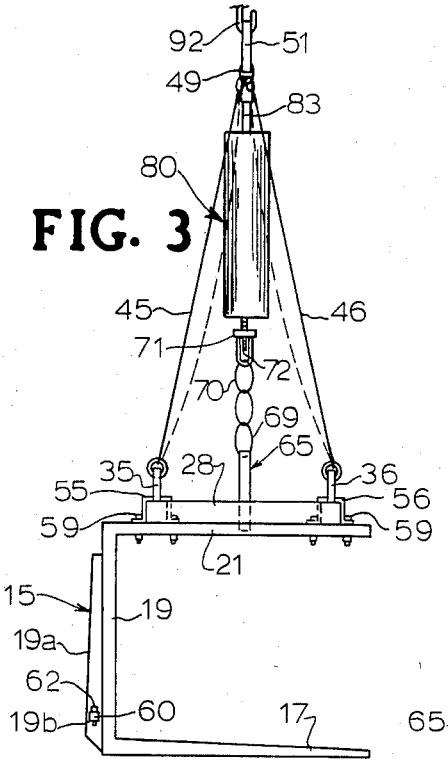
FIG. 3
FIG. 4
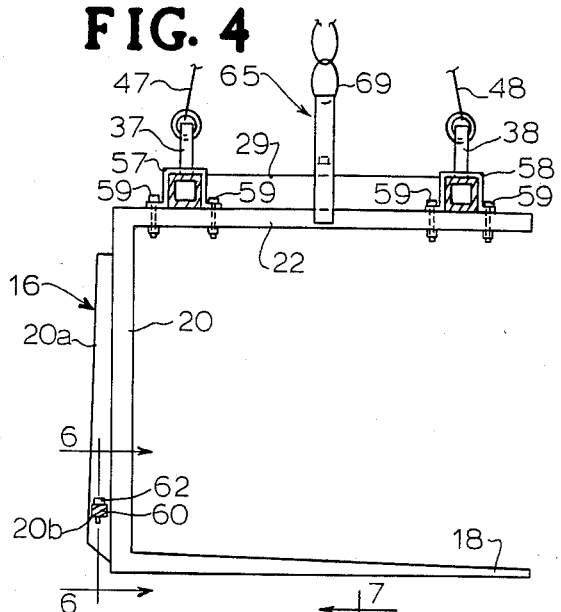
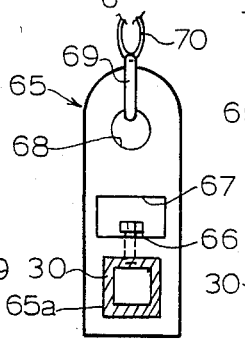
FIG. 7
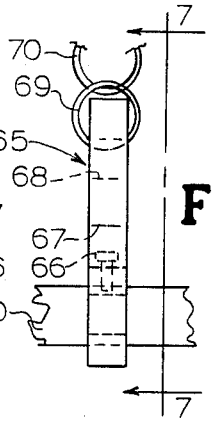
FIG. 8
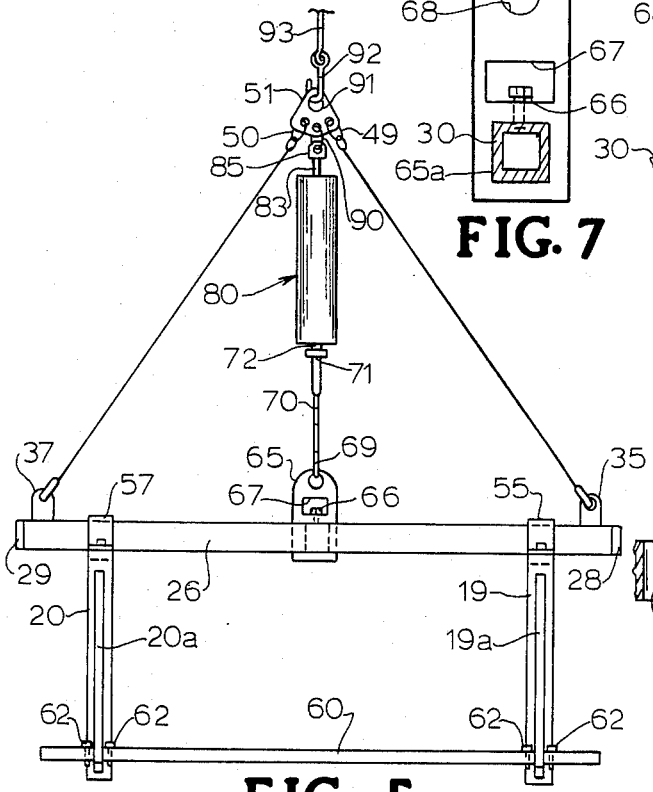
FIG. 5
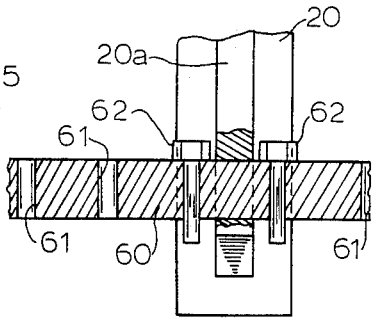
FIG. 6

CRANE/HOIST FORKLIFT-TYPE LIFTING APPARATUS

CROSS REFERENCE TO RELATED APPLICATIONS

This application is a continuation-in-part of copending application Ser. No. 487,319, entitled "FORK-LIFT-TYPE LIFTING APPARATUS", filed Apr. 21, 1983.

TECHNICAL FIELD

The present invention relates to crane, hoist, or the like, load-lifting devices and more specifically to a fork-lift-type apparatus that can be employed for use with such lifting devices.

BACKGROUND ART

Forklift trucks have proven to be extremely useful in moving loads by means of inserting forks under the loads and raising the loads with the forks. Variations of the forklift-type structure for crane lifting are to be found in U.S. Pat. Nos. 3,897,097 and 3,971,478; British Pat. No. 791,430; and French Pat. No. 1.452.379. However, so far as applicant is aware, forklift-type lifting devices have not been widely applied in crane lifting and it is believed that one of the reasons for this is the fact that the prior art crane forklift devices have not adapted to lifting loads placed on non-level surfaces.

Additionally, U.S. Pat. Nos. 590,847; 2,847,245; 3,173,556; 3,193,887; 3,712,661 and 3,888,536 are mentioned as other forms of crane or hoist-type lift devices. U.S. Pat. No. 3,173,556, while not deemed of particular significance, does have a center telescoping member although structurally and functionally different from applicant's device.

Thus, the object of the invention becomes that of providing an improved forklift-type lifting apparatus for use with cranes, hoists, or the like.

DISCLOSURE OF INVENTION

A crane, hoist, or the like, forklift-type lifting apparatus according to the invention provides a pair of laterally-spaced, C-shaped claws or forks with a four-point cable support adjacent the four corners of the frame. Additionally, there is provided a spring-loaded, adjustable, releasable, over-center device at the point of balance of the forklift-type lifting apparatus. In operation, the present invention apparatus, for purposes of loading, can be tilted or maneuvered in essentially any direction prior to loading so as to place the C-shaped fork tongues under the load even if on a non-level surface and then gradually after loading apply the lifting force first to the spring-loaded over-center device and then gradually to the other cables at the four corner points of support. An alternative embodiment of the invention provides for the four corner cables to be adjustably secured to the frame.

DESCRIPTION OF DRAWINGS

FIG. 3 is an end elevation view of the FIG. 1 device and load arrangement with dashed lines being used to indicate non-loaded cable position.

FIG. 4 is an enlarged section view taken substantially along line 4—4 of FIG. 1.

FIG. 5 is a rear elevation view of the FIG. 2 lifting apparatus with the cables shown taut.

FIG. 6 is an enlarged, fragmentary section detail taken generally along line 6—6 of FIG. 4.

FIG. 7 is an enlarged section view taken generally along line 7—7 of FIG. 8.

FIG. 8 is a fragmentary side elevation view of the FIG. 7 apparatus.

BEST MODE FOR CARRYING OUT THE INVENTION

Figure 1:
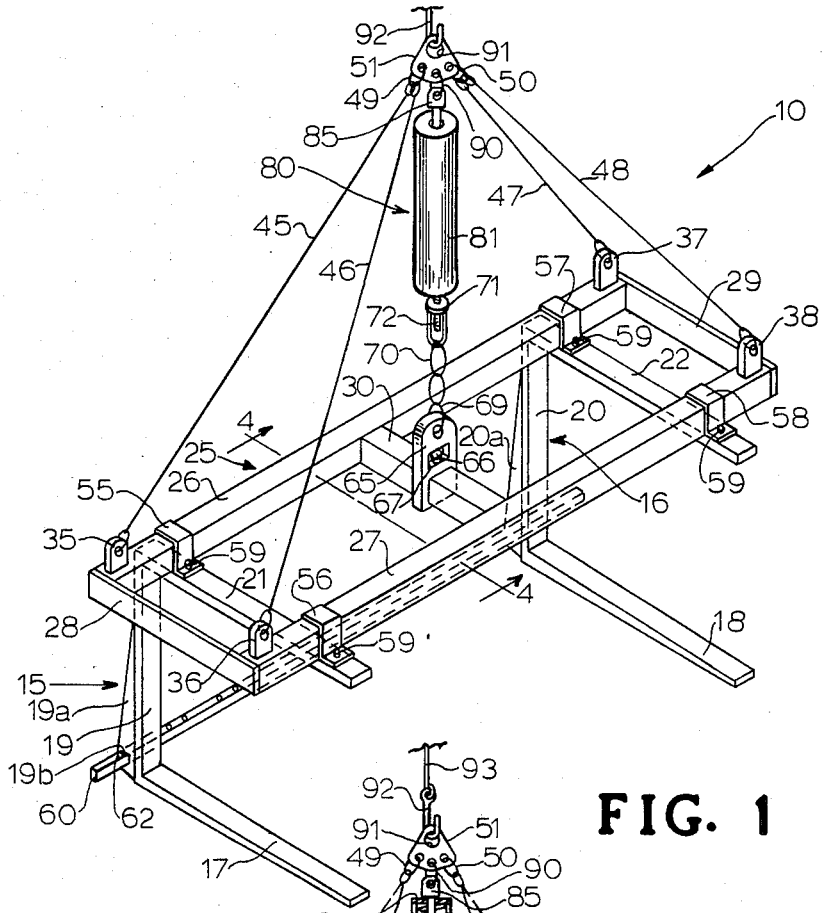
FIG. 1 is a perspective view of the first embodiment of the crane/hoist forklift-type lifting apparatus of the present invention with the outer cables shown taut and the over-center spring-loaded device without slack and attached as the apparatus would be at the point of beginning to lift a load (no load shown).

Making reference to FIGS. 1–8 and the first embodiment, the crane, hoist, or the like, forklift-type lifting apparatus 10 of the present invention comprises a pair of laterally-spaced, C-shaped claws or forks 15, 16 formed by horizontal bottom tongues 17, 18, vertical backrests 19, 20 and horizontal top bars 21, 22.

A structurally rigid top frame 25 is established by welding longitudinal side bars 26, 27, end bars 28, 29 and cross-bar 30 together. Cable support brackets 35, 36, 37, 38 are rigidly secured to the outermost top surfaces of longitudinal side bars 26, 27. Brackets 35, 36, 37, 38 in turn receive the main support fixed length cables 45, 46, 47, 48. Cables 45, 46 are attached to a common ring 49 and cables 47, 48 are in turn attached to a common ring 50. Rings 49, 50 in turn are attached to clevis 51.

Referring back to C-shaped claws or forks 15, 16, forks 15, 16 are adjustably suspended from longitudinal bars 26, 27 by means of brackets 55, 56, 57, 58. Brackets 55, 56, 57, 58 mount on bars 26, 27 and are fixedly secured to top bars 21, 22. Bolts 59 secure brackets 55, 56, 57, 58 to top bars 21, 22. By loosening bolts 59, forks 15, 16 can be slidably moved inward toward crossbar 30 or outward toward end bars 28, 29 enabling various size loads to be accommodated.

Backrests 19, 20 of forks 15, 16 have made integral therewith knee stiffeners or braces **19*a*, 20*a*. Braces 19*a*, 20*a* prevent inward bowing of backrests 19, 20 and also serve to slidably support a stabilizer bar 60 which serves to reinforce forks 15, 16. Braces 19*a*, 20*a* have holes 19*b*, 20*b* through which passes the stabilizer bar 60. Stabilizer bar 60 has holes 61 therein which receives pins 62 therethrough, as best seen in FIG. 6. Once C-forks 15,**

16 are positioned on longitudinal side bars 26, 27 pins 62 are passed through appropriate holes 61 in bar 60 to fixedly secure bar 60 and backrests 19, 20 together.

Referring back to crossbar 30 which is integrally secured between longitudinal side bars 26, 27, bar 30 receives an adjustable bracket 65. FIG. 7 most clearly illustrates bracket 65 and crossbar 30. Hole 65*a* in bracket 65 receives crossbar 30, thus enabling bracket 65 to slide on crossbar 30. A locking bolt 66 situated within opening 67 in bracket 65 is provided to be tightened down upon bar 30 to prevent movement of bracket 65 on bar 30. Bracket 65 has a top hole 68 (FIG. 7) which receives ring 69. Ring 69 in turn receives chain 70. Chain 70 extends from ring 69 to adjustable bracket 71. Adjustable bracket 71 in turn is threadably secured on shaft 72 which extends from over-center device 80.

Figure 2:
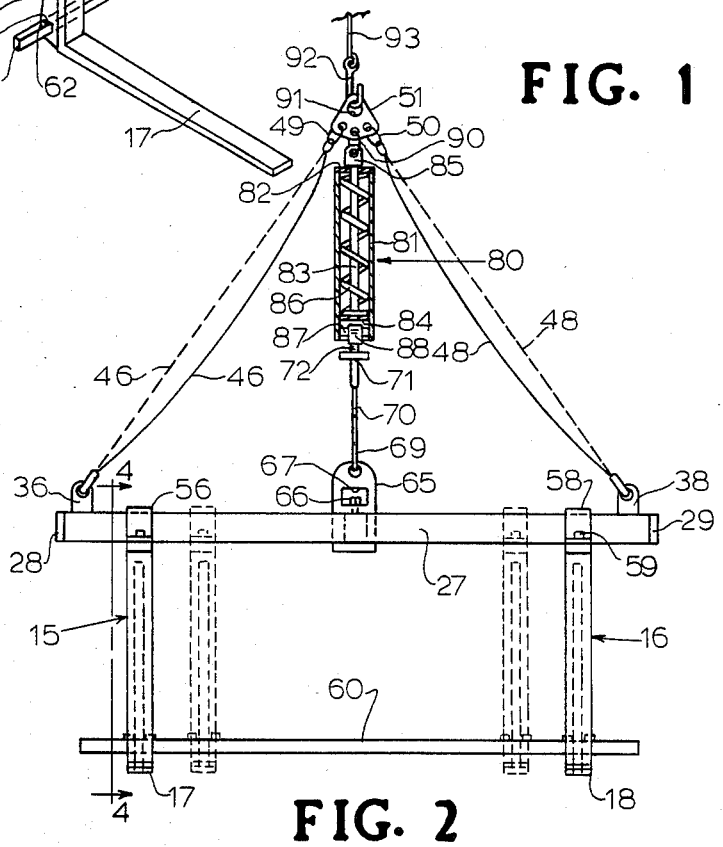
FIG. 2 is a front elevation view of the lifting apparatus of FIG. 1 with the over-center device sectioned, the device being illustrated in a non-loaded situation with the outer cables and the over-center spring-loaded device slack with dashed lines being used to indicate loaded cable positions and alternative fork positions.

At this point, the description will shift to describing the spring-loaded, adjustable, releasable, over-center device 80. Over-center device 80, as best seen in FIG. 2, comprises a tubular member 81 which is closed at the top by top plate 82. A rod 83 extends through top plate 82 and extends downward to and is fixedly secured to a spring support plate 84 which slides within tubular member 81. The upper free end of rod 83 is rigidly secured to a bracket 85. Within tubular member 81 and surrounding rod 83 is a spring 86, the lower end of which rests on plate 84 and the upper end of which is confined by top plate 82. Spring 86 is in a relaxed or expanded position in FIG. 2 with no load on apparatus 10. Below bottom plate 84 and still within tubular member 81 is a horizontal shaft 87 which pivotally receives sleeves 88 which is integral with shaft 72. As previously mentioned, bracket 71 is adjustable lengthwise on shaft 72 which is pivotal about shaft 87. The invention apparatus thus readily accommodates to various non-level ground loading and off-balanced load conditions.

Bracket 85 is pivotally secured to clevis 51 by means of lift ring 90. Clevis 51 in turn has hole 91 in the top thereof which receives hook 92 which is attached to the main crane or hoist cable 93. Briefly, as hoist cable 93 is retracted, rod 83 is raised within tubular member 81 thus compressing spring 86. Once spring 86 has been substantially compressed, cables 45, 46, 47, 48 are moved from the solid line relaxed position of FIG. 2 to the solid line taut positions of FIGS. 1 and 3. This is accomplished after a load great enough to overcome the force of spring 86 is placed upon forklift-type lifting apparatus 10. Prior to loading, entire forklift-type lifting apparatus 10 can be tilted or maneuvered around the point of balance which is purposely located at the location of bracket 65 so as to accommodate the positioning of forklift-type apparatus 10 to uneven conditions on which the load is resting prior to being lifted. This feature has proven to be of unique advantage.

Figure 9:
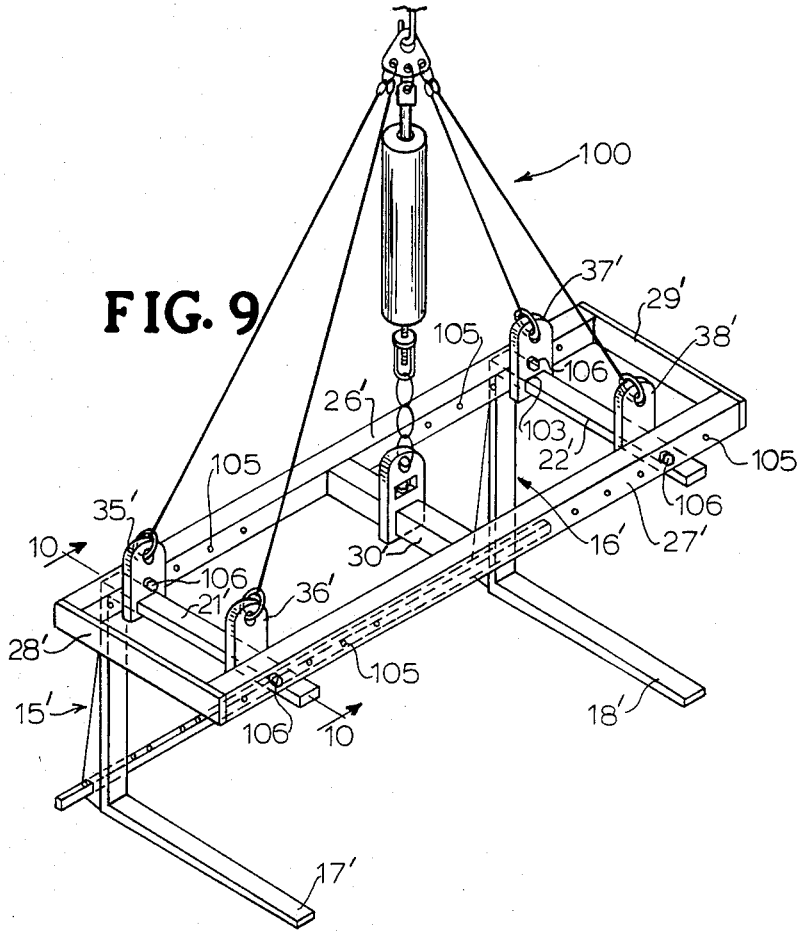
FIG. 9 is a perspective view of a second embodiment of the crane/hoist forklift-type lifting apparatus of the present invention with the outer cables shown taut and the over-center spring-loaded device without slack and attached as the apparatus would be at the point of beginning to lift a load (no load shown).
Figure 10:
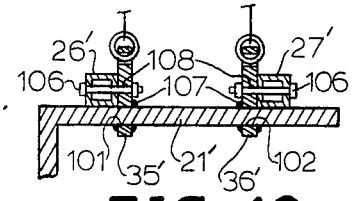
FIG. 10 is a fragmentary detail section view taken generally along line 10—10 of FIG. 9.

Switching now to the second or alternate embodiment of FIGS. 9 and 10, the crane, hoist, or the like, forklift-type lifting apparatus 100 is similar in construction to apparatus 10 except that cable support brackets 35′, 36′, 37′, 38′ are adjustably mounted to longitudinal bars 26′, 27′ and are provided with holes therein 101, 102, 103, 104 (not shown) which receive top bars 21′, 22′ of forks 15′, 16′ which are secured to brackets 35′, 36′, 37′, 38′ by spot welds 107 (FIG. 10). Further, longitudinal bars 26′, 27′ are provided with holes 105 therein which align with mating holes 108 (FIG. 10) in brackets 35′, 36, 37′, 38′ and which receive bolts 106 therein thus locking brackets 35′, 36′, 37′, 38′ to longitudinal side bars 26′, 27′. Similar to the first embodiment, bolts 106 may be removed and forks 15′, 16′ repositioned inward toward crossbar 30′ or outward toward end bars 28′, 29′ and bolts 106 re-inserted to secure locking of brackets 35′, 36′, 37′, 38′ to longitudinal side bars 26′, 27′.

Figure 11:
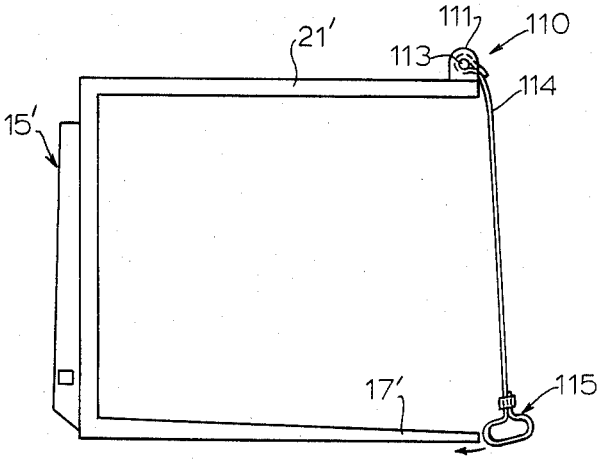
FIG. 11 is an end elevation view of one of the C-shaped forks with a closed end safety device as may be employed with the present invention.
Figure 12:
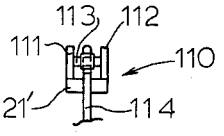
FIG. 12 is a fragmentary detail end elevation view illustrating how the safety device is pivoted at the top of the C-fork.

FIGS. 11 and 12 offer a modification to the first and second embodiments and may be employed with both arrangements. C-forks 15′, 16′ are modified so that an enclosed or box-type loader is achieved. It has been found that the load lift capacity can be greatly increased, e.g., two to three times, by closing the ends of the forks. In this arrangement, brackets 110 are fixedly secured as by welding, or the like, to the outermost ends of top bars 21′, 22′. Brackets 110, as shown in FIG. 12, comprises a pair of opposed members 111, 112 with a shaft 113 fixed therebetween. Shaft 113 receives a cable thereon, secured by conventional means, such that cable 114 pivots about shaft 113 and extends downward therefrom across the face of top bar 21′. The lower end of cable 114 is formed in a loop arrangement 115 by conventional means and is adapted to loop over the outermost end of tongue 17′. By closing the ends of C-forks 15′, 16′, at least two things are accomplished. First, when a load force is applied to the C-forks tongues 17′, 18′ are prevented from flexing downward a distance greater than allowed by the length of cable 114. When this flexing of tongue 17 takes place and cable 114 is tightened, a box-like enclosure is achieved and further prevents any of the load from sliding laterally off of forks 15′, 16′. Secondly, as has been previously mentioned, a greater load capacity is achieved. It has been found in one embodiment that a C-fork with a tongue length of 36 inches will flex downward 1¼ inches when a 12,000 lb. load is placed thereon (this being a rated 4,000 lb. load). By utilizing cables 114, a rate load of 8,000 to 12,000 lbs. can be achieved. This rated load effectively equals 24,000 to 36,000 lbs. The disclosed and described means of closing C-forks 15′, 16′ offers a quick and easy means of closing the ends prior to lifting of the load. Other arrangements are envisioned while not departing from the scope of the apparatus of the invention.

Thus, in summary, the crane forklift-type lifting apparatus of the present invention provides a point of balance which allows tilting or maneuvering of apparatus 10 or 100 in any direction, i.e., fore, aft, or up and down, prior to loading and particularly when the load is on an uneven surface. Further, when the invention apparatus is loaded and the four main cables tighten, this allows the four outer corners of crane forklift-type lifting apparatus 10 or 100 to assume the load from over-center device 80. These features with the various adjustability features that have been described thus provide a unique crane, hoist, or the like, lifting apparatus not heretofore available in the art.

What is claimed is:

1. A forklift-type lifting apparatus for use with an overhead crane, hoist, or the like, having a main lift cable, said apparatus comprising:

(a) a pair of C-shaped claws, each having a pair of substantially parallel vertically-spaced bottom and top arms extending generally horizontally and a vertical backrest joined thereto;

(b) a rectangular frame structure having integrally joined side bars and a strengthening member located midway of the length of and connected to said side bars;

(c) claw support means serving to support and secure said claws on said structure such that said claws assume essentially parallel positions on said structure and said top arms of said claws extend between said side bars;

(d) means providing cable attachment and support points at each of four positions on said lifting apparatus corresponding to corners of a rectangle defined by said positions;

(e) frame structure lift means including a lift element adapted to be secured to and lifted by a said main lift cable and attached to and extending between said lift element and each of said support points a frame structure lift cable of fixed length;

(f) a central support linkage having an upper end connected to said lift element, a lower end, and a spring connection between said upper and lower ends requiring spring loading prior to the load on said lower end being transferred to said upper end; and (g) a bracket member slidably mounted on said strengthening member enabling the balance point of said frame structure to be adjusted and including means to adjustably secure said bracket member to said member to establish a selected balance point, the said lower end of said support linkage being connected to said bracket member at said selected balance point, whereby said frame structure lift cables are normally slack prior to the load being transferred to said upper end of said support linkage to enable said fork-lift type lift apparatus when not loaded to be supported by said central support linkage and to be maneuvered around said point of balance and when loaded to support said forklift-type apparatus and the load thereon by said frame structure lift cables.

2. A forklift-type lifting apparatus for use with an overhead crane, hoist, or the like, as claimed in claim 1 and wherein said central support linkage includes means enabling the distance between said upper and lower ends to be adjusted when said spring connection is not loaded such that the amount of load required to be applied to said central support linkage before it is also assumed by said frame structure lift cables may be adjusted.

3. A forklift-type lifting apparatus for use with an overhead crane, hoist, or the like, as claimed in claim 1 wherein said claw support means includes means to movably secure said claws on said side bars so said claws may be laterally adjusted relative to each other.

* * * * *